US008404415B2

(12) United States Patent
Iwanaga et al.

(10) Patent No.: US 8,404,415 B2
(45) Date of Patent: Mar. 26, 2013

(54) ELECTROPHOTOGRAPHIC PHOTORECEPTOR, AND PROCESS CARTRIDGE AND IMAGE FORMING APPARATUS USING THE SAME

(75) Inventors: Takeshi Iwanaga, Kanagawa (JP); Shigeru Yagi, Kanagawa (JP); Nobuyuki Torigoe, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 740 days.

(21) Appl. No.: 12/543,201

(22) Filed: Aug. 18, 2009

(65) Prior Publication Data

US 2010/0203435 A1 Aug. 12, 2010

(30) Foreign Application Priority Data

Feb. 9, 2009 (JP) ..... 2009-027585

(51) Int. Cl.
*G03G 5/147* (2006.01)

(52) U.S. Cl. ..... 430/66; 430/67; 399/159; 399/111

(58) Field of Classification Search ..... 430/66, 430/67; 399/111, 159
See application file for complete search history.

(56) References Cited

U.S. PATENT DOCUMENTS

| | | | | |
|---|---|---|---|---|
| 4,737,429 | A | 4/1988 | Mort et al. | |
| 2002/0051918 | A1 | 5/2002 | Miyamoto et al. | |
| 2008/0070138 | A1* | 3/2008 | Yagi et al. | 430/66 |
| 2008/0254379 | A1 | 10/2008 | Iwanaga et al. | |

FOREIGN PATENT DOCUMENTS

| | | |
|---|---|---|
| JP | A-2-110470 | 4/1990 |
| JP | A-11-186571 | 7/1999 |
| JP | A-2003-27238 | 1/2003 |
| JP | A-2003-316053 | 11/2003 |
| JP | A-2008-209747 | 9/2008 |
| JP | A-2008-268266 | 11/2008 |

OTHER PUBLICATIONS

Office Action issued in Japanese Patent Application No. 2009-027585, dated Dec. 14, 2010 (with translation).

* cited by examiner

*Primary Examiner* — Christopher Rodee
(74) *Attorney, Agent, or Firm* — Oliff & Berridge, PLC

(57) ABSTRACT

Disclosed is an electrophotographic photoreceptor including: an electroconductive substrate; a photosensitive layer arranged on or above the electroconductive substrate; and a surface layer arranged on or above the photosensitive layer, and containing about 90% or more by atom of gallium (Ga), oxygen (O) and hydrogen (H), and having an atomic number density of about $7.8\times10^{22}$ $cm^{-3}$ or more.

18 Claims, 5 Drawing Sheets

ELECTROPHOTOGRAPHIC PHOTORECEPTOR, AND PROCESS CARTRIDGE AND IMAGE FORMING APPARATUS USING THE SAME

CROSS-REFERENCE TO RELATED APPLICATION

This application is based on and claims priority under 35 USC 119 from Japanese Patent Application No. 2009-027585 filed on Feb. 9, 2009.

BACKGROUND

1. Technical Field

The invention relates to an electrophotographic photoreceptor, and a process cartridge and an image forming apparatus each using this photoreceptor.

2. Related Art

In recent years, electrophotography has widely been used in copying machines, printers and the like. An electrophotographic photoreceptor (hereinafter also referred to as a "photoreceptor") used in an image forming apparatus utilizing electrophotography is subjected or exposed to various contacts or stresses, so that the condition of the photoreceptor inside the apparatus deteriorates. On the other hand, photoreceptors are required to have higher reliability as the digitalization or colorization of image forming apparatus progresses.

SUMMARY

According to a first aspect of the invention, there is provided an electrophotographic photoreceptor including:

an electroconductive substrate;

a photosensitive layer arranged on or above the electroconductive substrate; and a surface layer arranged on or above the photosensitive layer, and containing 90% or more by atom or about 90% or more by atom of gallium (Ga), oxygen (O) and hydrogen (H), and having an atomic number density of $7.8\times10^{22}$ $cm^{-3}$ or more, or about $7.8\times10^{22}$ $cm^{-3}$ or more in the layer.

BRIEF DESCRIPTION OF THE DRAWINGS

Exemplary embodiment of the present invention will be described in detail base on the following figures, wherein.

DETAILED DESCRIPTION

Figure 1:
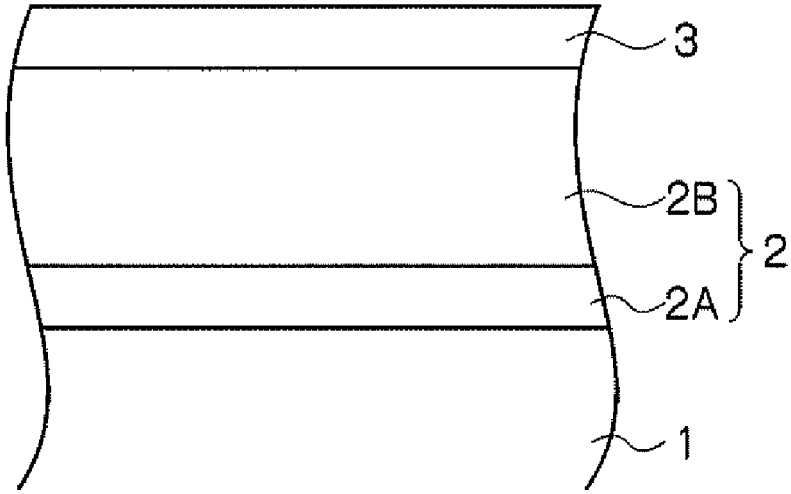
FIG. 1 is a schematic sectional view illustrating an example of the layer structure of an electrophotographic photoreceptor according to an exemplary embodiment of the invention.

Exemplary embodiments of the invention will be described in detail hereinafter.

(Electrophotographic Photoreceptor)

An electrophotographic photoreceptor according to an exemplary embodiment of the invention has an electroconductive substrate, a photosensitive layer arranged on or above the electroconductive substrate, and a surface layer arranged on or above the photosensitive layer, containing 90% or more by atom of gallium (Ga), oxygen (O) and hydrogen (H), and having an atomic number density of $7.8\times10^{22}$ $cm^{-3}$ or more in the layer.

When a layer or film composed of oxygen and gallium is used as a surface layer of an electrophotographic photoreceptor, the mechanical endurance and the oxidation resistance of the surface are very good and further image defects based on the adhesion of an electric discharge product are suppressed and these characteristics are kept over time.

Such a surface layer easily cracks. For example, at the time when the layer is used, particularly, in combination with a contact charger (such as a bias charge roll (BCR)) or when printing is repeated at a high temperature and a high humidity (for example, at a temperature of 28° C. and a relative humidity of 85%) and then a pause is made for several hours, or at some other time, an image deletion along the crack may easily be generated.

About the generation of the crack, some causes are considered. One thereof is a difference in mechanical property between the surface layer and an underlying layer thereof. For example, in a case where the surface layer and the underlying layer are largely different from each other in mechanical properties such as hardness and elasticity so that the underlying layer is more easily deformed than the surface layer, the deformation of the surface layer does not follow that of the underlying layer when these layers receive a mechanical stress from a contacting member such as a cleaning blade. As a result, the surface layer would crack.

In a case where the thermal expansion coefficient of the underlying layer is largely different from that of the surface layer, compressive or tensile stress is easily generated between the surface layer and the underlying layer when the layers are kept at a temperature different from the temperature when the layers are formed. When the mechanical strength of the surface layer is insufficient at this time, the surface layer or film may be broken or crack. When the film thickness of the surface layer is too large, the surface layer may peel without crack.

In the meantime, an electrophotographic photoreceptor and a contacting member (such as a contact charger, or a cleaning unit) catch an alien substance other than toner, such as a paper piece, or dust or sands in the surrounding environment, so that the alien substance may be sandwiched between the photoreceptor and the contact member. At this time, the photoreceptor is pressed by the alien substance so as to be pushed inwards in the film thickness direction. As a result, the photoreceptor surface may crack, and may be further damaged into some other form.

Thus, in the electrophotographic photoreceptor according to the exemplary embodiment, a surface layer containing gallium (Ga), oxygen (O) and hydrogen (H) in an amount of 90% or more by atom is used, and the atomic number density (number density of atoms) in this surface layer is limited to a specific range, thereby restraining the surface layer from cracking or peeling. This would be based on the following reason: the surface layer, which contains the specific elemental composition and further having the atomic number density, is a dense film, and contains a larger amount of chemical bonds between oxygen and Ga than other layers, so that the film itself has a large bonding strength; therefore, the film does not easily crack or peel even when the film receives compressive or tensile stress in a direction perpendicular to or parallel in the film surface.

Hereinafter, the electrophotographic photoreceptor according to exemplary embodiments will be described with reference to the drawings.

FIG. 1 is a schematic sectional view illustrating an example of the layer structure of the photoreceptor of the exemplary embodiment. In FIG. 1, reference numbers 1, 2, 2A, 2B and 3 represent an electroconductive substrate, an organic photosensitive layer, a charge generating layer, a charge transporting layer and a surface layer, respectively. The photoreceptor illustrated in FIG. 1 has a layer structure having, on the electroconductive substrate 1, the charge generating layer 2A, the charge transporting layer 2B, and the surface layer 3 multilayered in this order. The organic photosensitive layer 2 is composed of the charge generating layer 2A and the charge transporting layer 2B.

Figure 2:
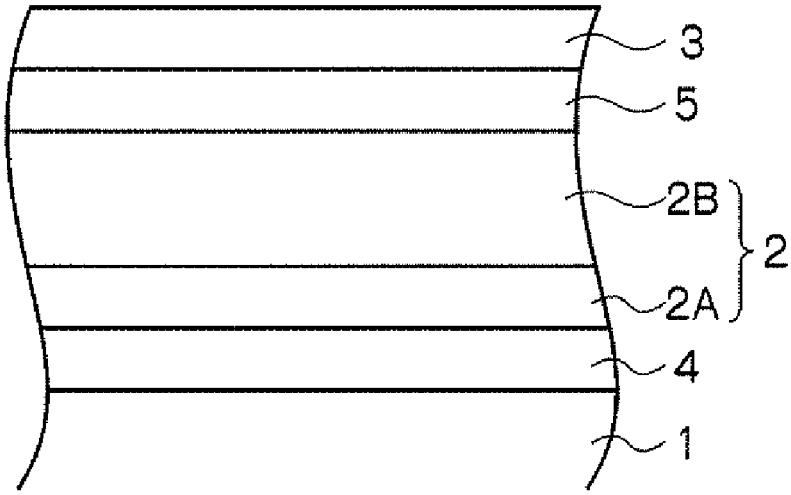
FIG. 2 is a schematic sectional view illustrating another example of the layer structure of the electrophotographic photoreceptor according to the exemplary embodiment.

FIG. 2 is a schematic cross-sectional view showing another exemplary layer configuration of a photoreceptor according to the present exemplary embodiment. In FIG. 2, reference numeral 4 denotes an undercoat layer, and reference numeral 5 denotes an intermediate layer, while the others are the same as defined in FIG. 1. The photoreceptor shown in FIG. 2 has a layer configuration in which an undercoat layer 4, a charge generating layer 2A, a charge transport layer 2B, an intermediate layer 5 and a surface layer 3 are multilayered in this order on a conductive substrate 1.

The following will describe details of each of the layers in the electrophotographic photoreceptor of the exemplary embodiment. First, the surface layer will be described.

The atomic number density (the number density of atoms) in the surface layer is $7.8\times10^{22}$ $cm^{-3}$ or more, desirably $8.0\times10^{22}$ $cm^{-3}$ or more. In connection with the upper limit value (critical value) of the atomic number density in the surface layer, the atomic number density of crystalline gallium oxide is desirably $10.4\times10^{22}$ $cm^{-3}$ or less, or about $10.4\times10^{22}$ $cm^{-3}$ or less. If this atomic number density in the surface layer is smaller than the above-mentioned lower limit, the bonding force of the film is insufficient and resultantly the surface layer may crack or peel by internal stress resulting from a difference in thermal expansion between the surface layer and the underlying layer thereof or by shearing force applied to the surface layer from a contacting member when the photoreceptor is rotated.

The surface layer having the specified atomic number density is obtained, for example, by forming a film by plasma chemical vapor deposition (CVD) using a high-frequency discharge (for example, discharge of a high frequency of 13.56 MHz) at a self bias voltage of 200 V or more. The self bias voltage is a direct current (DC) bias voltage generated at a discharge electrode when plasma is generated by high-frequency electric power, and is peculiar to plasma generated by the use of a high frequency. This is generated by a difference in mass between electrons and ions. When a film is formed in plasma in the state that a self bias voltage is generated, it appears that charged particles which are to turn to a gallium oxide film, for example, oxygen ions, in the plasma are accelerated and hit onto the surface, whereby the film becomes denser. Of course, the method for obtaining the surface layer having the specified atomic number density is not limited to this method.

The atomic number density is measured in accordance with Rutherfold backscattering spectrometry (RBS) and hydrogen forwardscattering spectrometry (HFS) as follows: a backscattering measuring device (trade name: AN-250, manufactured by NHV Corp.) is used to measure the density under conditions that incident ions are $^4He^+$, the voltage thereof is 23 MeV, and the incident angle is 75°. In connection with the positions of detectors, the scattering angle is set to 160° in the RBS measurement, and the recoiling angle is set to 30° in the HFS measurement. The surface density of the atoms is obtained from the analysis of the resultant spectra. The film thickness value obtained from an experiment different from the above is used to calculate the atomic number density in the film.

The surface layer is formed to contain gallium (Ga), oxygen (O) and hydrogen (H). When any surface layer contains, as constituting elements thereof gallium and oxygen, the mechanical endurance and the oxidation resistance of the surface layer surface are improved and the adhesion of electric discharge products is restrained. Furthermore, these characteristics are maintained over the passage of time. When the surface layer further contains, as a constituting element thereof, hydrogen, the flexibility of the bonding between elements is increased.

In the surface layer, the total proportion of gallium (Ga), oxygen (O) and hydrogen (H) in all constituting atoms is 90% or more by atom. It is particularly desired in the gallium oxide based surface layer, which is composed of oxygen, gallium and hydrogen, that the proportion of oxygen, gallium and hydrogen in all the constituting elements is 90% or more by atom and farther the element component ratio of oxygen to gallium (O/Ga) is 1.1 or more and 1.5 or less, or about 1.1 or more and about 1.5 or less. It is more desired that the proportion of oxygen, gallium and hydrogen in all the constituting elements is 95% or more by atom or about 95% or more by atom and further the element component ratio of oxygen to gallium (O/Ga) is 1.1 or more and 1.4 or less, or about 1.1 or more and about 1.4 or less. The proportion of hydrogen in all the constituting elements in the surface layer is desirably 0.1% or more by atom and 30% or less by atom, or about 0.1% or more by atom and about 30% or less by atom, more desirably 0.5% or more by atom and 25% or less by atom, or about 0.5% or more by atom and about 25% or less by atom.

The film having such a composition has an appropriate electroconductivity and restrains the residual potential from rising.

The composition of the film is measured by RBS and HFS described above.

The surface layer may be amorphous or crystalline. In order to make the slippage of the photoreceptor good, the surface layer is desirably amorphous. Whether or not the surface layer is crystalline or amorphous is judged in accordance with whether or not dots or line are present in a diffraction image obtained by reflection high-energy electron diffraction (RHEED) measurement. Amorphousness is also specified by a matter that a sharp peak peculiar to any diffraction angle does not make its appearance in X-ray diffraction spectrometry.

The film thickness of the surface layer is desirably 1.5 μm or more and 10.0 μm or less, or about 1.5 μm or more and 10.0 μm or less. If the film thickness of the surface layer is less than the lower limit in the range, damages including a crack may be generated in the surface by stress applied to the surface layer surface along a direction perpendicular to the surface when an alien substance is pushed against the surface by a contacting member. From such a viewpoint, it is more desired that the film thickness is larger. However, if the film thickness of the surface layer is larger than the upper limit in the range, internal stress generated by a difference in thermal expansion between the surface layer and the underlying layer thereof may become large so that the film may be swelled or peeled off.

The following will describe an example of the method for forming the surface layer of the electrophotographic photoreceptor according to the exemplary embodiment.

Figure 4:
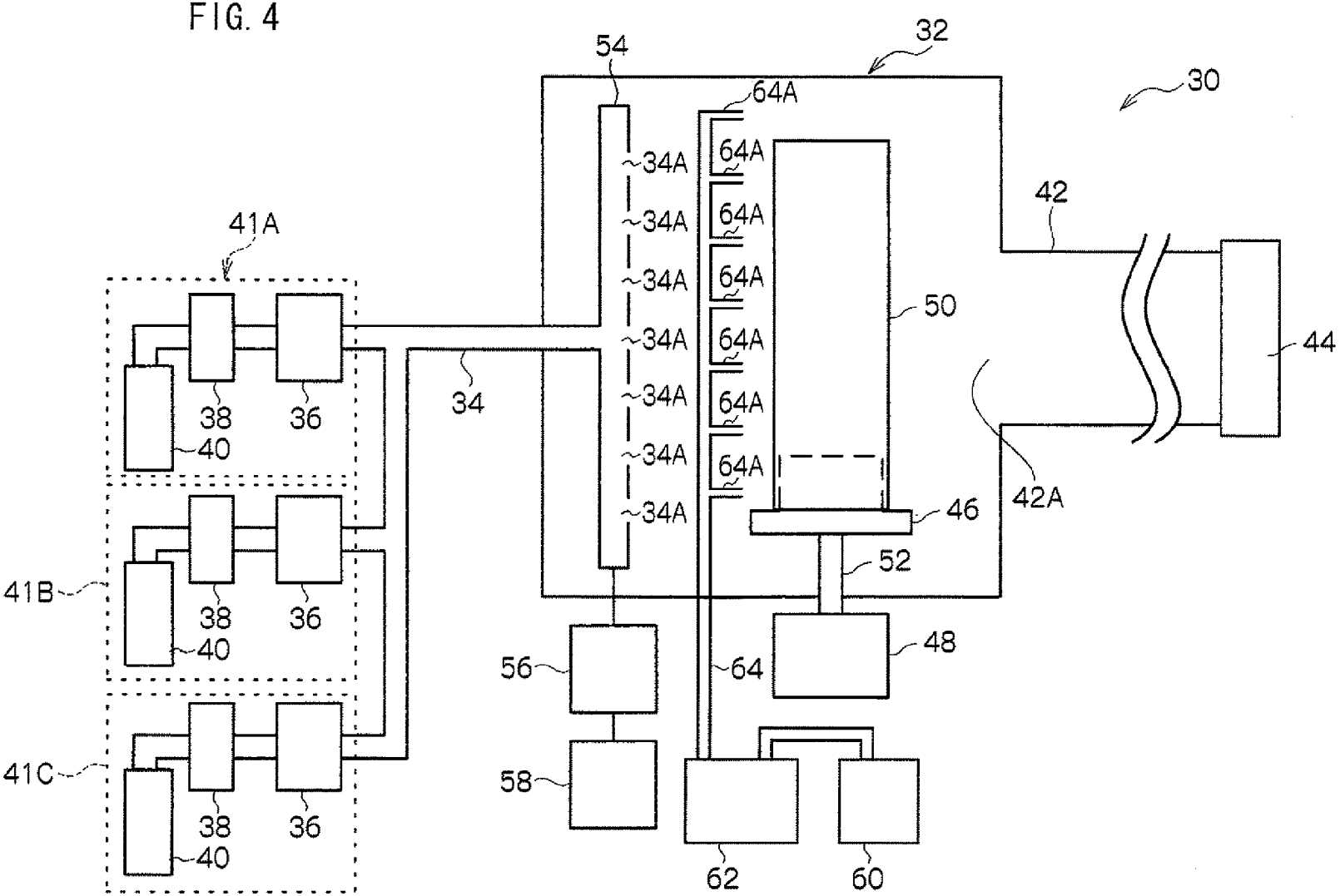
FIG. 4 is a schematic view illustrating an example of a film-forming apparatus used to form a surface layer of the electrophotographic photoreceptor according to the exemplary embodiment.

FIG. 4 is a schematic view illustrating an example of a film-forming apparatus used to form the surface layer of the electrophotographic photoreceptor according to the exemplary embodiment.

As illustrated in FIG. 4, a film-forming apparatus 30 includes a vacuum chamber 32 in which the air is discharged to produce a vacuum. Inside the vacuum chamber 32, a supporting member 46 is set to support an electrophotographic photoreceptor 50 wherein a surface layer has not yet been formed (hereinafter referred to as the non-coated photoreceptor 50) so as to be rotated around the longitudinal direction of the non-coated photoreceptor 50 as a rotary axis direction. The supporting member 46 is connected through a supporting axis 52 for supporting the supporting member 46 to a motor 48. The driving force of the motor 48 may be transmitted through the supporting axis 52 to the supporting member 46.

After the non-coated photoreceptor 50 is held on the supporting member 46, when the motor 48 is driven, and the driving force of the motor 48 is transferred to the non-coated photoreceptor 50 through the supporting axis 52 and the supporting member 46, the non-coated photoreceptor 50 rotates with the longitudinal direction thereof as the direction of rotating axis.

At one end of the vacuum chamber 32, an exhaust pipe 42 for exhausting the gas inside the vacuum chamber 32 is installed. One end of the exhaust pipe 42 is installed to be linked to the inside of the vacuum chamber 32 through the opening 42A of the vacuum chamber 32, while the other end thereof is connected to a vacuum exhausting device 44. The vacuum exhausting device 44 includes one or a plurality of vacuum pumps, but if necessary, may also include a device for adjusting the exhaust rate, such as a conductance valve.

When the vacuum exhausting device 44 is driven to discharge the air in the vacuum chamber 32 through the exhaust pipe 42, the pressure in the vacuum chamber 32 is reduced to a predetermined pressure (ultimate vacuum). The ultimate vacuum is desirably 1 Pa or less, more desirably 0.1 Pa or less. As will he described later, in the invention, the element component ratio (of oxygen to gallium) is controlled by the ratio between the supplying speed of a gallium material and that of oxygen. When this ultimate vacuum is high, the oxygen amount in the reactive atmosphere is made larger than the supplied oxygen amount by effect of oxygen and water in the remaining air, so that the performance of controlling the composition is deteriorated.

Near the non-coated photoreceptor 50 set inside the vacuum chamber 32, a discharge electrode 54 is provided. The discharge electrode 54 is electrically connected to a high-frequency power source 58 through a matching box 56.

The discharge electrode 54 may be plate-shaped. The discharge electrode 54 is installed such that its longitudinal direction is identical with the direction of the rotating axis (longitudinal direction) of the non-coated photoreceptor 50, and is installed at a predetermined distance away from the peripheral surface of the non-coated photoreceptor 50. The discharge electrode 54 is hollow in shape (has a hollow structure) and has one or a plurality of openings 34A for supplying a plasma-generating gas at the discharge surface. If the discharge electrode 54 does not have a hollow structure and has no opening 34A at the discharge surface, a configuration in which the plasma-generating gas is supplied through a separately installed gas supply port, and is led through between the non-coated photoreceptor 50 and the discharge electrode 54, may also be used. In order to prevent discharge between the discharge electrode 54 and the vacuum chamber 32, the electrode surface other than the surface facing the non-coated photoreceptor 50 may be covered by a member that is earthed by having a clearance of about 3 mm or less.

When high frequency electric power is supplied from the high frequency power supply 58 to the discharge electrode 54 through the matching box 56, electric discharge by the discharge electrode 54 is carried out.

In the region which is inside the vacuum chamber 32 and faces the non-coated photoreceptor 50 through the discharge electrode 54, there is installed a gas supply pipe 34 for supplying gas toward the non-coated photoreceptor 50 inside the vacuum chamber 32 through the interior of the discharge electrode 54 having a hollow structure.

One end of the gas supply pipe 34 is linked to the inside of the discharge electrode 54 (that is, linked to the inside of the vacuum chamber 32 through the discharge electrode 54 and the openings 34A), while the other end is connected respectively to a gas supply unit 41A, a gas supply unit 41B and a gas supply unit 41C.

Each of the gas supply unit 41A, gas supply unit 41B and gas supply unit 41C is constructed to include a mass flow controller (MFC) 36 for regulating the amount of gas supply, a pressure regulator 38, and a gas supply source 40. The respective gas supply sources 40 for the gas supply unit 41A, the gas supply unit 41B and the gas supply unit 41C are connected to the other end of the gas supply pipe 34, through the pressure regulator 38 and the MFC 36.

Gas inside the gas supply source 40 is supplied toward the non-coated photoreceptor 50 in the vacuum chamber 32 through the gas supply pipe 34, the discharge electrode 54 and the openings 34A, while the supply pressure is regulated by the pressure regulator 38, and the amount of gas supply is regulated by the MFC 36.

The type of the gas filled in the respective gas supply sources 40 included in the gas supply unit 41A, the gas supply unit 41B and the gas supply unit 41C, may be of the same type, but in the case where the treatment is performed using multiple types of gases, gas supply sources 40 filled with different types of gases may be used. In this case, a gas mixture prepared by supplying the different types of gases from the respective gas supply sources 40 of the gas supply unit 41A, the gas supply unit 41B and the gas supply unit 41C to the gas supply pipe 34 and mixing these gases is supplied toward the non-coated photoreceptor 50 inside the vacuum chamber 32 through the discharge electrode 54 and the openings 34A.

A raw material gas containing gallium is also supplied to the non-coated photoreceptor 50 in the vacuum chamber 32. The raw material gas is introduced from a raw material gas supply source 62 to the vacuum chamber 32, by a gas inlet pipe 64 having shower nozzles 64A at the pipe end. As for the raw material gas, for example, a gaseous compound containing gallium, such as trimethylgallium or triethylgallium, metal gallium, or the like may be used. As the oxygen source, substances containing oxygen, such as $O_2$, may be used.

Film formation is, for example, carried out as follows. First, while the interior of the vacuum chamber 32 is depressurized to a predetermined pressure by the vacuum exhausting device 44, high frequency electric power is supplied from the high frequency power supply 58 to the discharge electrode 54 through the matching box 56, and at the same time, a plasma-generating gas is introduced from the gas supply pipe 34 to the vacuum chamber 32. At this time, plasma is formed such that the plasma radiates from the discharge surface side of the discharge electrode 54 to the opening 42A side of the exhaust pipe 42.

The pressure inside the vacuum chamber 32 at the time of plasma formation may be 1 Pa to 500 Pa.

According to the present exemplary embodiment, the plasma-generating gas contains oxygen. The plasma-generating gas may also be a gas mixture further containing an inert gas such as He or Ar, or a non-film forming gas such as $H_2$. This non-film forming gas or inert gas is used, for example, for controlling the reaction atmosphere, such as the pressure inside the reaction vessel. In particular, hydrogen is important for reactions at low temperatures, as will be described later.

Subsequently, hydrogen from a carrier gas supply source 60 is passed through the raw material gas supply source 62, to dilute trimethylgallium (an organometallic compound containing gallium) gas using hydrogen as a carrier gas, and this hydrogen-diluted gas is introduced into the vacuum chamber 32 through the gas inlet pipe 64 and the shower nozzles 64A. Thereby, activated oxygen and trimethylgallium are allowed to react in an atmosphere containing active hydrogen, and thus a film containing hydrogen, oxygen and gallium is formed on the surface of the non-coated photoreceptor 50.

In the present exemplary embodiment, a film of a compound of gallium and oxygen containing hydrogen may also be formed on the non-coated photoreceptor 50, by introducing a mixture of $O_2$ gas and $H_2$ gas into the discharge electrode 54 as described above, and at the same time, making an active species to thereby decompose trimethylgallium gas.

When hydrogen gas and oxygen gas are simultaneously activated in the plasma, and reacted with an organometallic compound containing gallium, an etching effect of a hydrocarbon group contained in the organometal gas, such as a methyl group or an ethyl group, is obtained by means of the activated hydrogen generated by plasma discharge. In this manner, a film of a compound containing gallium and oxygen, which has a film quality equivalent to the film quality obtained from high temperature (for example, 200° C. or higher but 600° C. or lower) growth, may be formed even at low temperature, on the surface of an organic material (organic photosensitive layer) without damaging the organic material.

Specifically, for example, the hydrogen gas concentration in the plasma-generating gas supplied for activation may be 10% by volume or more. If the hydrogen gas concentration is less than 10% by volume, the etching reaction may not occur sufficiently at low temperatures, and as compared to the case where the hydrogen gas concentration is 10% by volume or more, a gallium oxide compound having a high hydrogen content is produced, thus often resulting in a film having insufficient water resistance and that is unstable in the atmosphere.

Further, the elemental composition ratio of O/Ga is controlled by, for example, the supply amounts of the gallium raw material and the oxygen raw material. In this case, the gas supply molar ratio of oxygen gas to trimethylgallium (TMGa) gas, $[O_2]/[TMGa]$, may be n the range of 0.1 to 10, or about 0.1 to about 10.

Also in the cases of forming a surface layer by other methods, the growth atmosphere is controlled by altering the gas supply amounts, or is controlled by the ratio of gallium to oxygen contained in the target material in the process of sputtering or the like.

The temperature at the surface of the non-coated photoreceptor 50 during the film formation is not particularly limited, but the treatment may be performed at a temperature of 0° C. or higher but 150° C. or lower. The temperature at the surface of the non-coated photoreceptor 50 may also be 100° C. or lower. Furthermore, even if the temperature at the surface of the non-coated photoreceptor 50 is 150° C. or lower, when the surface temperature is increased to above 150° C. under the effects of plasma, the organic photosensitive layer may be damaged by heat. Thus, it is possible to set the temperature at the surface of the non-coated photoreceptor 50, with this effect taken into consideration.

The surface temperature of the non-coated photoreceptor 50 may be controlled by a method not depicted in the drawings, or may be subjected to natural temperature elevation during the discharge. In the case of heating the non-coated photoreceptor 50, the heater may be installed on the outside or inside of the non-coated photoreceptor 50. In the case of cooling the non-coated photoreceptor 50, a coolant gas or liquid may be circulated inside the non-coated photoreceptor 50.

If it is desired to avoid temperature elevation of the non-coated photoreceptor 50 due to the discharge, it is effective to adjust the high energy gas stream colliding against the surface of the non-coated photoreceptor 50. In this case, the conditions such as gas flow rate, discharge output and pressure may be regulated to obtain a desired temperature.

The plasma generating method used in the film forming apparatus 30 shown in FIG. 4 utilizes a high frequency oscillator, but the plasma generating method is not limited to this, and may also utilize, for example, a microwave oscillator or an apparatus based on the electro cyclotron resonance technique or helicon plasma technique in combinaton with the high frequency oscillator. The high frequency oscillator may be of inductive type or capacitive type.

As the gas containing gallium, triethylgallium may be used instead of trimethylgallium gas, or a mixture of two or more of these compounds may also be used.

By means of the method as described above, activated hydrogen, oxygen and gallium are made to be present on the photoreceptor, and the activated hydrogen has an effect of detaching the hydrogen atoms in the hydrocarbon group constituting the organometallic compound, such as a methyl group or an ethyl group, as molecules. Therefore, on the surface of the photoreceptor, there is formed a surface layer formed of a hard film in which hydrogen, oxygen and gallium constitute three-dimensional bonding.

Hereinafter, another configuration of the electrophotographic photoreceptor according to the present exemplary embodiment will be described in detail.

The electrophotographic photoreceptor according to the present exemplary embodiment has a layer configuration in which an organic photosensitive layer and a surface layer are multilayered in this order on a conductive substrate. If necessary, intermediate layers such as an undercoat layer may be provided between the two layers. The organic photosensitive layer may include two or more layers as described above, which may have separated functions.

The photosensitive layer is preferably an organic photosensitive layer. In the electrophotographic photoreceptor according to the exemplary embodiment, cracking, which is generated and is problematic when an underlying layer is composed of materials similar to those of the organic photosensitive layer and the mechanical properties thereof are different from those of films made of material containing oxygen, gallium and hydrogen as main constituent elements, is suppressed.

The organic photosensitive layer may be composed of a separate charge generating layer and a separate charge transport layer which have separated functions. With respect to the layer configuration of separated functions, the charge generating layer and the charge transport layer may be disposed such that the charge generating may be at the surface side, or the charge transport layer may be at the surface side. If necessary, an undercoat layer may be provided between the conductive substrate and the organic photosensitive layer. An intermediate layer such as a buffering layer may also be provided between the surface layer and the organic photosensitive layer.

The organic polymer compound contained in the organic photosensitive layer may be thermoplastic or thermosetting, or may be formed by reacting two kinds of molecules. An intermediate layer may be provided between the organic photosensitive layer and the surface layer, from the viewpoint of improving the hardness or expansion coefficient, controlling the elasticity, improving the adhesiveness, or the like. The intermediate layer may be formed of a material having properties that are intermediate between the properties of the surface layer and the properties of the organic photosensitive layer (the charge transport layer when it is a layer of separated functions). If an intermediate layer is to be provided, the intermediate layer may function as a layer for trapping charges.

Figure 3:
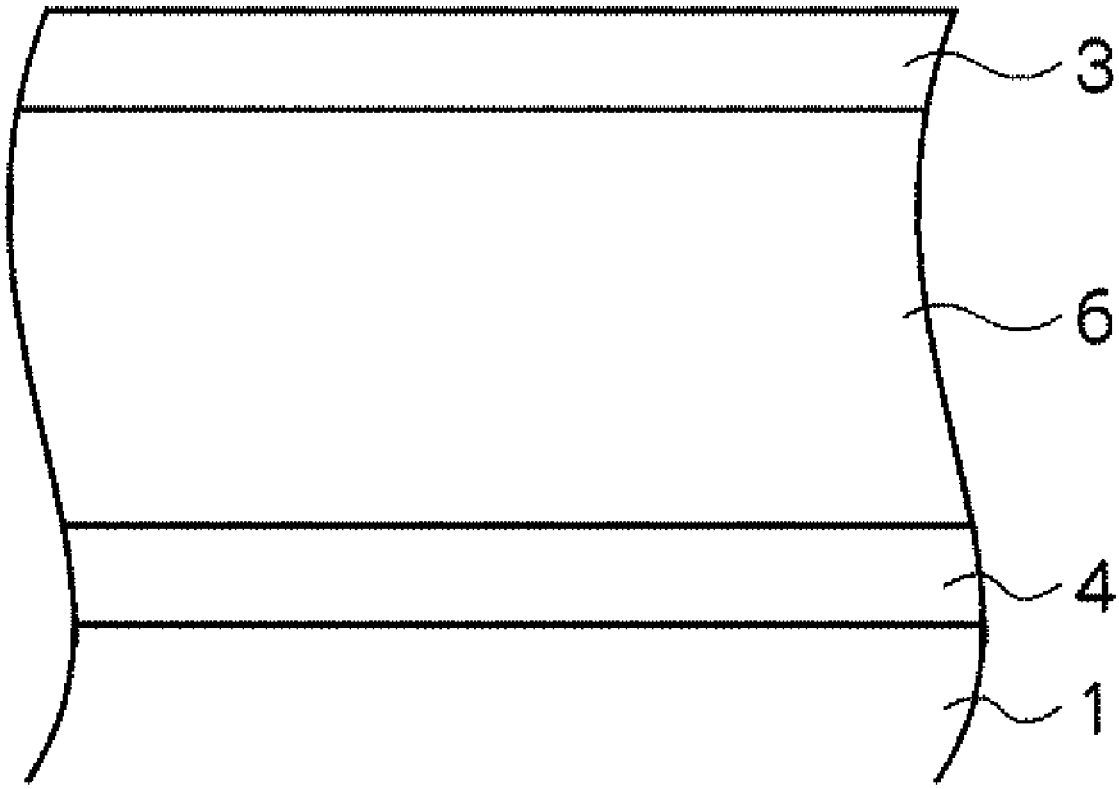
FIG. 3 is a schematic sectional view illustrating still another example of the layer structure of the electrophotographic photoreceptor according to the exemplary embodiment.

The organic photosensitive layer may be an organic photosensitive layer composed of a separate charge generating layer and a separate charge transport layer which have separated functions (see FIG. 1 and FIG. 2), or alternatively, may be a single layered organic photosensitive layer with integrated functions (see FIG. 3). In the case of a layer of separated functions, the organic photosensitive layer may have a charge generating layer provided at the surface side of the electrophotographic photoreceptor, or may have a charge transport layer provided at the surface side thereof. Hereinafter, explanation will be carried out mainly on the organic photosensitive layer with separated functions.

In the case where the surface layer is formed on the organic photosensitive layer by the method described below, a layer for absorbing shortwave radiation such as ultraviolet rays may be provided in advance on the surface of the organic photosensitive layer before forming the surface layer, in order to prevent degradation of the organic photosensitive layer under irradiation with a shortwave electromagnetic radiation other than heat, or the like.

A layer containing an ultraviolet absorbent (for example, a layer formed by coating or the like, in which an ultraviolet absorbent is dispersed in a polymer resin) may also be provided on the surface of the organic photosensitive layer.

As such, when an intermediate layer is provided on the surface of the photoreceptor before forming the surface layer, the influence exerted on the organic photosensitive layer by ultraviolet rays in the case of forming the surface layer, or by shortwave radiation such as ultraviolet rays from corona discharge or various light sources in the case of using the photoreceptor in an image forming apparatus, is suppressed.

The surface layer may be either amorphous or crystalline, but in view of ameliorating the smoothness of the photoreceptor surface, the surface layer may be amorphous.

Next, the conductive substrate will be described. Examples of the conductive substrate include a metal drum formed from aluminum, copper, iron, stainless steel, zinc, nickel or the like; a material produced by vapor depositing a metal such as aluminum, copper, gold, silver, platinum, palladium, titanium, nickel-chrome, stainless steel or copper-indium, on a base material such as sheet, paper, plastic or glass; a material produced by vapor depositing an electrically conductive metal compound such as indium oxide or tin oxide, on the above-mentioned base material; a material produced by putting a metal foil on the above-mentioned base material; a material conductively treated by dispersing carbon black, indium oxide, powdered tin oxide-antimony oxide, powdered metal, copper iodide or the like in a binding resin, and coating the dispersion on the above-mentioned base material; and the like. The shape of the conductive substrate may be any of a drum shape, a sheet shape and a plate shape. Here, the term "electrical conductive" means that the volume resistivity is $10^9$ Ω·cm or less.

In the case of using a metallic pipe substrate as the conductive substrate, the surface of the metallic pipe substrate may be in an untreated state, or the substrate surface may be roughened in advance by a surface roughening treatment. Such surface roughening treatment prevents, in the case of using a coherent light source such as laser beam as the exposure light source, wood grain-like density unevenness which may be generated inside the photoreceptor by interference light. Examples of the surface treatment methods include mirror cutting, etching, anodic oxidation, rough cutting, centerless grinding, sand blast, wet horning and the like.

In particular, a substrate produced by applying anodic oxidation treatment to the surface of an aluminum substrate as follows may be used as a conductive substrate, from the viewpoint of improving the adhesiveness to the organic photosensitive layer or improving the film forming properties.

Hereinafter, the method for producing a conductive substrate with anodic oxidation treatment applied to the surface, will be described.

First, pure aluminum or an aluminum alloy (for example, aluminum or aluminum alloy having an alloy number in the 1000's, 3000's or 6000's as defined in JISH4080) is provided as the substrate. Subsequently, the substrate is subjected to anodic oxidation treatment. The anodic oxidation treatment is performed in an acid bath of chromic acid, sulfuric acid, oxalic acid, phosphoric acid, boric acid, sulfamic acid or the like, but a treatment using a sulfuric acid bath is frequently used. The anodic oxidation treatment is performed under the conditions of, for example, a sulfuric acid concentration of 10% by weight to 20% by weight, a bath temperature of 5° C. or higher but 25° C. or lower, a current density of 1 A/dm$^2$ to 4 A/dm$^2$, an electrolytic voltage of 5 V or higher but 30 V or lower, and a treatment time of 5 minutes or longer but 60 minutes or shorter, but the conditions are not limited thereto.

The anodic oxidation film thus formed on the aluminum substrate is porous, highly insulating, and has a very unstable surface, and thus after the film formation, the properties thereof are prone to change over time. To prevent this change in the properties thereof the anodic oxidation film is further subjected to a pore sealing treatment. Examples of the method for pore sealing treatment include a method of immersing the anodic oxidation film in an aqueous solution containing nickel fluoride or nickel acetate, a method of immersing the anodic oxidation film in boiling water, a method of treating the anodic oxidation film with pressurized steam, and the like. Among these methods, the method of immersing the anodic oxidation film in an aqueous solution containing nickel acetate is particularly frequently used.

On the surface of the anodic oxidation film thus treated by a pore sealing treatment, metal salts and the like attached by the pore sealing treatment remain in excess. When these metal salts and the like remain in excess on the anodic oxidation film of the substrate, these substances exert adverse effects on the quality of the coating films formed on the anodic oxidation film. In addition, since low resistance components generally tend to remain thereon, when this substrate is used in the photoreceptor to form images thereon, the law resistant components may cause scumming.

Accordingly, after the pore sealing treatment, in order to remove those metal salts and the like attached by the pore sealing treatment, the anodic oxidation film is subjected to washing treatment. The washing treatment may be performed by washing the substrate once with pure water, or the washing of the substrate may also be carried out through multistage washing processes. Here, as for the washing solution for the final washing process, a washing solution as pure as possible (deionized) is used. It is possible to perform washing by physical rubbing using a contacting member such as brush, in any one step during the multistage washing processes.

The layer thickness of the anodic oxidation film thus formed on the surface of the conductive substrate, may be in the range of about 3 μm to about 15 μm. On the anodic oxidation film, a layer called barrier layer is present along the porous-shaped outermost surface of the porous anodic oxidation film. The layer thickness of the barrier layer may be 1 nm to 100 nm in the electrophotographic photoreceptor according to the present exemplary embodiment. As such, a conductive substrate treated by anodic oxidation is obtained.

In the conductive substrate thus obtained, the anodic oxidation film formed on the substrate by anodic oxidation treatment has high carrier blocking properties. Therefore, the point defects (black spots, scumming) that are generated when a photoreceptor utilizing such conductive substrate is mounted on an image forming apparatus, and reversal development (negative/positive development) is performed, are prevented, and at the same time, the phenomenon of current leakage from a contact charger, which is likely to occur during contact charging, is prevented. Furthermore, when the anodic oxidation film is subjected to a pore sealing treatment, changes over time in the properties of the anodic oxidation film after the production thereof are prevented. When washing of the conductive substrate is performed after the pore sealing treatment, metal salts and the like attached to the surface of the conductive substrate due to the pore sealing treatment, may be removed. Thus, when images are formed by an image forming apparatus equipped with a photoreceptor produced using this conductive substrate, the generation of scumming is suppressed.

Subsequently, the organic photosensitive layer provided on the conductive substrate will be described in detail. The organic photosensitive layer mainly includes a charge generating layer and a charge transport layer, but as discussed above, an undercoat layer or an intermediate layer may be provided, according to necessity.

First, examples of the material constituting the undercoat layer include acetal resins such as polyvinylbutyral; polymeric resin compounds such as polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins, as well as organometallic compounds containing zirconium, titanium, aluminum, manganese, silicon atoms, or the like.

These compounds are used, for example, individually or as mixtures or polycondensates of a plurality of the compounds. Among these, the organometallic compounds containing zirconium or silicon may be preferably used, since their residual potential is low and their potential change due to an environment is reduced, and at the same time, their potential change due to repeated use is also reduced. The organometallic compounds may be used individually, or as mixtures of two or more species, or may also be used as mixtures with the aforementioned binding resins.

Examples of organosilicon compounds (organometallic compounds containing silicon atoms) include vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane, γ-chloropropyltrimethoxysilane and the like. Among these, silane coupling agents such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl) ethyltrimethoxysilane, N-2-(aminoethyl) 3-aminopropyltrimethoxysilane, N-2-(aminoethyl) 3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane may be used.

Examples of organozirconium compounds (organometallic compounds containing zirconium) include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Examples of organotitanium compounds (organometallic compounds containing titanium) include tetraisopropyl titanate, tetra-normal-butyl titanate, butyl titanate dimer, tetra(2-ethylhexyl) titanate, titanium acetylacetonate, polytitanium acetylacetonate, titanium octylene glycolate, titanium lactate ammonium salts, titanium lactate, titanium lactate ethyl ester, titanium triethanolaminate, polyhydroxytitanium stearate, and the like.

Examples of organoaluminum compounds (organometallic compound containing aluminum) include aluminum isopropylate, monobutoxyaluminum diisopropylate, aluminum butylate, ethylacetoacetate aluminum diisopropylate, aluminum tris(ethylacetoacetate), and the like.

As for the solvent used in the coating liquid for undercoat layer formation for forming an undercoat layer, there may be mentioned known organic solvents, for example, aromatic hydrocarbon solvents such as toluene and chlorobenzene; aliphatic alcohol solvents such as methanol, ethanol, n-propanol, isopropanol and n-butanol; ketone solvents such as acetone, cyclohexanone and 2-butanone; halogenated aliphatic hydrocarbon solvents such as methylene chloride, chloroform and ethylene chloride; cyclic or straight-chained ether solvents such as tetrahydrofuran, dioxane, ethylene glycol and diethyl ether; ester solvents such as methyl acetate, ethyl acetate and n-butyl acetate; and the like. These solvents may be used individually, or as mixtures of two or more species. As for the solvent used in the case of mixing two or more solvents, any solvent may be used as long as the solvent mixture is capable of dissolving a binding resin.

The formation of an undercoat layer is carried out by first providing a coating liquid for undercoat layer formation prepared by dispersing and mixing a coating agent for undercoat layer and a solvent, and applying the coating liquid on the surface of the conductive substrate. As the method for applying the coating liquid for undercoat layer formation, a conventional method such as dip coating, ring coating, wire bar coating, spray coating, blade coating, knife coating or curtain coating, may be used. When an undercoat layer is to be formed, the layer may be formed such that the layer thickness is in the range of 0.1 μm to 3 μm. When the layer thickness of the undercoat layer is set within such layer thickness range, desensitization, and elevation of potential due to repeated use may be prevented without making the electrical barrier excessively strong.

When an undercoat layer is formed on the conductive substrate as such, the wetting properties required when a layer to be formed on the undercoat layer is formed by coating, may be improved, and at the same time, the function of the undercoat layer as an electrically blocking layer is accomplished.

The surface roughness of the undercoat layer may be adjusted to have a degree of roughness in the range of about 1/(4n)-fold provided that n is the refractive index of the layer provided on the outer side of the undercoat layer) to one-fold the wavelength λ of the exposing laser to be used. Adjustment of the surface roughness may be carried out by adding resin particles to the coating liquid for undercoat layer formation. Then, when a photoreceptor produced by adjusting the surface roughness of the undercoat layer is used in an image forming apparatus, images with interference fringes caused by the laser light source may be prevented.

As the resin particles, silicone resin particles, cross-linkable PMMA resin particles and the like are used. For an adjustment of surface roughness, the undercoat layer surface may be polished. As for the polishing method, buff polishing, sand blast treatment, wet homing, grinding treatment or the like may be used. In the photoreceptor used in image forming apparatuses having a configuration of positive charging, since the laser incident light is absorbed extremely near the outermost surface of the photoreceptor and further scattered within the organic photosensitive layer, the adjustment of the surface roughness of the undercoat layer is not needed so strongly.

Various additives may be added to the coating liquid for undercoat layer formation, from the viewpoints of improving electrical properties, improving the environmental stability and improving the image quality. Examples of the additives include electron transporting materials such as quinone compounds such as chloranil, bromoanil and anthraquinone; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole or 2,5-bis(4-naphthyl)-1,3,4-oxadiazole and 2,5-bis(4-diethylaminophenyl)-1,3,4-oxadiazole; xanthone compounds; thiophene compounds; diphenoquinone compounds such as 3,3',5,5'-tetra-t-butyldiphenoquinone; electron transporting pigments such as polycyclic condensation pigments and azo pigments; known materials such as zirconium chelate compounds, titanium chelate compounds, aluminum chelate compounds, titanium alkoxide compounds, organotitanium compounds and silane coupling agents; and the like.

Specific examples of the silane coupling agents as used herein include, but not limited to, silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropylmethyldimethoxysilane, N,N-bis(β-hydroxyethyl)-γ-aminopropyltriethoxysilane and γ-chloropropyltrimethoxysilane.

Specific examples of the zirconium chelate compounds include zirconium butoxide, ethyl zirconium acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, isostearate zirconium butoxide, and the like.

Specific examples of the titanium chelate compounds include tetraisopropyl titanate, tetra-normal-butyl titanate, butyl titanate dimer, tetra(2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate, polyhydroxytitanium stearate, and the like.

Specific examples of the aluminum chelate compounds include aluminum isopropylate, monobutoxyaluminum diisopropylate, aluminum butylate, ethyl acetoacetate aluminum diisopropylate, aluminum tris(ethylacetoacetate), and the like.

These additives may be used individually, but may also be used as mixtures or polycondensates of a plurality of compounds.

The coating liquid for undercoat layer formation described above may contain at least one electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid, and the like. Among these, more preferably, a fluorenone compound, a quinone compound, or a benzene derivative having an electron withdrawing substituent such as Cl, CN or $NO_2$ may be used. Thereby, it is possible to improve the photosensitivity of the organic photosensitive layer, or to reduce the residual potential, and at the same time, deterioration of photosensitivity due to repeated use may be reduced, thus the density unevenness is suppressed in the toner image formed by an image forming apparatus equipped with a photoreceptor including an electron accepting material in the undercoat layer.

In place of the coating agent for undercoat layer described above, it is also acceptable to use the following dispersive coating agent for undercoat layer. Thereby, since the resistance value of the undercoat layer is appropriately adjusted, accumulation of residual charges is repressed, and at the same time, the layer thickness of the undercoat layer may be thickened, thus leakage resistance of the photoreceptor, and particularly prevention of leakage during contact charging may be achieved.

This dispersive coating agent for undercoat layer may be exemplified by a dispersion in a binding resin of a powder of a metal such as aluminum, copper, nickel or silver; an electrically conductive metal oxide such as antimony oxide, indium oxide, tin oxide or zinc oxide; an electrically conductive substance such as carbon fiber, carbon black or graphite powder; or the like. As the electrically conductive metal oxide, metal oxide particles having an average primary particle diameter of 0.5 μm or less may be used. If the average primary particle diameter is too large, localized formation of electrically conductive paths is likely to take place, leakage of current may occur, and as a result, there may be fogging or leakage of large current from the electric charger, in some cases. It is necessary to adjust the undercoat layer to have an appropriate resistance value, so as to improve the leakage resistance. Therefore, the metal oxide particles described above may have a powder resistance of about $10^2$ Ω·cm to about $10^{11}$ Ω·cm.

Furthermore, if the resistance value of the metal oxide particles is lower than the lower limit of the above range, sufficient leakage resistance may not be obtained, whereas if the resistance value is higher than the upper limit of the range, the residual potential may be increased. Accordingly, particles of a metal oxide having a resistance value within the above-mentioned range, such as tin oxide, titanium oxide or zinc oxide, may be used. The metal oxide particles may also be used as mixtures of two or more species. When the metal oxide particles are subjected to a surface treatment with a coupling agent, the resistance of the powder may be controlled. As for the coupling agent used in this case, the same materials as those used in the above-described coating liquid for undercoat layer formation, may be used. These coupling agents may be used as mixtures of two or more species.

This surface treatment of metal oxide particles may be performed by any known method, and a dry method or a wet method may be used.

In the case where a dry method is used, first, the metal oxide particles are dried by heating to remove the surface adsorbed water. By removing the surface adsorbed water, a coupling agent may be adsorbed onto the surface of the metal oxide particles. Subsequently, while the metal oxide particles are stirred with a mixer having high shear force, or the like, the coupling agent is added dropwise directly or as a solution of the coupling agent dissolved in an organic solvent or water, or sprayed together with dry air or nitrogen gas. Thus, the treatment is achieved so that the unevenness of adsorption is suppressed. When the coupling agent is to be added dropwise or sprayed, the process may be carried out at a temperature of 50° C. or higher. After the adding or spraying of the coupling agent, baking may be further performed at 100° C. or above. By the effect of baking, the coupling agent is cured, and a firm chemical reaction between the coupling agent and the metal oxide particles is induced. The baking may be performed at any temperature and time ranges, as long as desired electrophotographic properties may be obtained at these temperature and time.

When a wet method is to be used, in the same manner as in the dry method, the surface adsorbed water is first removed from the metal oxide particles. As a method for removing this surface adsorbed water, in addition to the same process of heat drying as in the dry method, there may be performed a method of removing the surface adsorbed water by heating the particles while stirring in a solvent which is used in the surface treatment, a method of removing the surface adsorbed water by azeotropical boiling with the solvent, or the like. Subsequently, the metal oxide particles are dispersed in a solvent using stirring, ultrasonic, a sand mill, an attriter, a ball mill or the like, and then a solution of the coupling agent is added thereto and stirred or dispersed in the dispersion, and thereafter the solvent is removed. Thus, the treatment is achieved so that the unevenness of adsorption is suppressed. After the removal of the solvent, baking may be further performed at 100° C. or above. The baking is carried out at any temperature and time range, as long as desired electrophotographic properties may be obtained at these temperature and time.

The amount of the surface treating agent for the metal oxide particles is required to be an amount capable of achieving desired electrophotographic properties. The electrophotographic properties are affected by the amount of the surface treating agent attached to the metal oxide particles after the surface treatment. In the case of silane coupling agents, the amount of attached agent is determined from the intensity of Si (attributable to the silane coupling agent), and the intensity of the main metal element in the metal oxide being used together, which are measured by fluorescent X-ray analysis. This intensity of Si measured by fluorescent X-ray analysis may be in the range of $1.0\times10^{-5}$-fold to $1.0\times10^{-3}$-fold the intensity of the main metal element in the metal oxide being used together. If the intensity of Si is lower than this range, defects in the image quality, such as fogging, may be likely to occur. If the intensity of Si exceeds the range, a decrease in the density resulting from the elevation of residual potential may be likely to occur.

Examples of the binding resin contained in the dispersive coating agent for undercoat layer include known polymer resin compounds, such as acetal resins such as polyvinylbutyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenolic resins, phenol-formaldehyde resins, melamine resins and urethane resins, as well as charge transporting resins having charge transporting groups, electrically conductive resins such as polyaniline, and the like.

Among them, it is desirable to use a resin which is insoluble in the coating solvent for the layer formed on the undercoat layer, and particularly it is desirable to use phenolic resins, phenol-formaldehyde resins, melamine resins, urethane resins, epoxy resins and the like. The ratio of the metal oxide particles to the binding resin in the dispersive coating liquid for undercoat layer formation is arbitrarily set in a range where desired photoreceptor properties are obtained.

As the method for dispersing the metal oxide particles which have been surface treated by the above-described methods in a binding resin, there may be mentioned a method of using a media disperser such as a ball mill, a vibratory ball mill, an attriter, a sand mill or a horizontal sand mill, or a medialess disperser such a stirrer, an ultrasonic disperser, a roll mill or a high pressure homogenizer. A collision method in which the dispersion liquid is dispersed at a high pressure with a high pressure homogenizer through liquid-liquid collision or liquid-wall collision, or a penetration method in which the dispersion liquid is dispersed by allowing the dispersion liquid to pass through fine flow channels at a high pressure, may be mentioned.

The method for forming the undercoating layer from the dispersive type undercoating-layer-forming coating agent is conducted in the same way in the case of conducting the method for forming the undercoating layer by use of the above-mentioned undercoating-layer-forming coating solution.

Next, with respect to the organic photosensitive layer, the charge transport layer and the charge generating layer will be described separately in this order.

Examples of the charge transporting material used in the charge transport layer include the following. That is, hole transporting materials such as oxadiazole derivatives such as 2,5-bis(p-diethylaminophenyl)-1,3,4-oxadiazole; pyrazoline derivatives such as 1,3,5-triphenyl-pyrazoline or 1-[pyridyl-(2)]-3-(p-diethylaminostyryl)-5-(p-diethylaminostyryl) pyrazoline; aromatic tertiary amino compounds such as triphenylamine, tri(p-methyl)phenylamine, N,N-bis(3,4-dimethylphenyl)biphenyl-4-amine, dibenzylaniline and 9,9-dimethyl-N,N-di(p-tolyl)fluorenone-2-amine; aromatic tertiary diamino compounds such as N,N'-diphenyl-N,N'-bis (3-methylphenyl)-[1,1-biphenyl]-4,4'-diamine; 1,2,4-triazine derivatives such as 3-(4'-dimethylaminophenyl)-5,6-di-(4'-methoxyphenyl)-1,2,4-triazine; hydrazone derivatives such as 4-diethylaminobenzaldehyde-1,1-diphenylhydrazone, 4-diphenylaminobenzaldehyde- 1,1-diphenylhydrazone, [p-(diethylamino)phenyl](1-naphthyl)phenylhydrazone, 1-pyrenediphenylhydrazone, 9-ethyl-3-[(2-methyl-1-indolinylimino)methyl]carbazole, 4-(2-methyl-1-indolinyliminomethyl)triphenylamine, 9-methyl-3-carbazole diphenylhydrazone, 1,1-di-(4,4'-methoxyphenyl) acrylaldehyde diphenylhydrazone and β,β-bis (methoxyphenyl)vinyldiphenylhydrazone; quinazoline derivatives such as 2-phenyl-4-styryl-quinazoline; benzofuran derivatives such as 6-hydroxy-2,3-di(p-methoxyphenyl)-benzofuran; α-stilbene derivatives such as p-(2,2-diphenylvinyl)-N,N-diphenylaniline; enamine derivatives; carbazole derivatives such as N-ethylcarbazole; and poly-N-vinylcarbazole and derivatives thereof, are used. There may be also mentioned polymers having groups derived from the above compounds in the main chain or in the side chain. These charge transporting materials are used individually, or in combination of two or more species.

As for the binding resin used in the charge transport layer, any resin may be used, and especially it is desirable that the binding resin is compatible with the charge transporting material, and has appropriate strength.

Examples of this binding resin include various polycarbonate resins formed from bisphenol A, bisphenol Z, bisphenol C, bisphenol TP or the like, or copolymers thereof; polyallylate resins or copolymers thereof; polyester resins, methacrylic resins, acrylic resins, polyvinyl chloride resins, polyvinylidene chloride resins, polystyrene resins, polyvinyl acetate resins, styrene-butadiene copolymer resins, vinyl chloride-vinyl acetate copolymer resins, vinyl chloride-vinyl acetate-maleic anhydride copolymer resins, silicone resins, silicone-alkyd resins, phenol-formaldehyde resins, styrene-acrylic copolymer resins, styrene-alkyd resins, poly-N-vinylcarbazole resins, polyvinylbutyral resins, polyphenylene ether resins, and the like. These resins are used individually or as mixtures of two or more species.

The molecular weight of the binding resin used in the charge transport layer is selected in accordance with the layer thickness of the organic photosensitive layer, or the film forming conditions such as solvent, but typically, the viscosity average molecular weight may be in the range of 3000 to 300,000, and desirably from 20,000 to 200,000.

The mixing ratio of the charge transporting material to the binding resin may be in the range of 10: to 1:5.

The charge transport layer and/or the below-described charge generating layer may contain additives such as an antioxidant, a photostabilizer and a thermal stabilizer, for the purpose of preventing the deterioration of the photoreceptor caused by the ozone generated in the image forming apparatus, oxidizing gases, light or heat.

Examples of the antioxidant include hindered phenol, hindered amine, para-phenylenediamine, arylalkane, hydroquinone, spiro-chroman, spiro-indanone or derivatives thereof, organic sulfur compounds, organic phosphorus compounds, and the like.

Specific exemplary compounds of the antioxidant include phenolic antioxidants such as 2,6-di-t-butyl-4-methylphenol, styrenized phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5'-methyl-2'-hydroxybenzyl)-4-methylphenyl acrylate, 4,4'-butylidene-bis-(3-methyl-6-t-butylphenol), 4,4'-thio-bis-(3-methyl-6-t-butyl-phenol), 1,3,5-tris(4-t-butyl-3-hydroxy-2,6-dimethylbenzyl) isocyanurate, tetrakis-[methylene-3-(3',5'-di-t-butyl-4'-hydroxyphenyl)propionate]-methane, 3,9-bis[2-[3-(3-t-butyl-4-hydroxy-5-methylphenyl)propionyloxy]-1,1-dimethylethyl]-2,4,8,10-tetraoxaspiro[5,5]undecane, stearyl 3-3',5'-di-t-butyl-4'-hydroxyphenyl)propionate, and the like.

Examples of the hindered amine compounds include bis(2,2,6,6-tetramethyl-4-piperidyl) sebacate, bis(1,2,2,6,6-pentamethyl-4-piperidyl) sebacate, 1-[2-[3-(3,5-di-t-butyl-4-hydroxyphenyl)propionyloxy]ethyl]-4-[3-(3,5-di-t-butyl-4-hydroxyp henyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, dimethyl succinate-1-(2-hydroxyethyl)-4-hydroxy-2,2,6,6-tetramethylpiperidine polycondensates, poly[{6-(1,1,3,3-tetramethylbutyl)amino-1,3,5-triazin-2,4-diyl}{(2,2,6,6-tetramethyl-4-piperi dyl) imino}hexamethylene {(2,3,6,6-tetramethyl-4-piperidyl) imino}], bis(1,2,2,6,6-pentamethyl-4-piperidyl) 2-(3,5-di-t-butyl-4-hydroxybenzyl)-2-n-butylmalonate, N,N'-bis(3-aminopropyl)ethylenediamine-2,4-bis[N-butyl-N-(1,2,2,6,6-pentamethyl-4-piperid yl)amino]-6-chloro-1,3,5-triazine condensate, and the like.

Examples of the organic sulfur-containing antioxidants include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, 2-mercaptobenzimidazole, and the like.

Examples of the organic phosphorus-containing antioxidants include trisnonylphenyl phosphite, triphenyl phosphite, tris(2,4-di-t-butylphenyl)-phosphite, and the like.

The organic sulfur-containing and organic phosphorus-containing antioxidants are known as secondary antioxidants, and when they are used in combination with primary antioxidants such as phenol-based or amine-based antioxidants, the anti-oxidizing effects may be increased synergistically.

Examples of the photostabilizer include derivatives of benzophenones, benzotriazoles, dithiocarbamates, tetramethylpiperidines and the like.

Examples of the benzophenone photostabilizer include 2-hydroxy-4-methoxybenzophenone, 2-hydroxy-4-octoxybenzophenone, 2,2'-di-hydroxy-4-methoxybenzophenone, and the like.

Examples of the benzotriazole photostabilizer include 2-(2'-hydroxy-5'-methylphenyl)-benzotriazole, 2-[2'-hydroxy-3'-(3",4",5',6'-tetra-hydrophthalimidomethyl)-5'-methylphenyl]-benzotriaz ole, 2-(2'-hydroxy-3'-t-butyl-5'-methylphenyl)-5-chlorobenzotriazole, 2-(2'-hydroxy-3'-t-butyl-5'-methylphenyl)-5-chlorobenzotriazole, 2-(2'-hydroxy-3 5'-t-butylphenyl)-benzotriazole, 2-(2'-hydroxy-5'-t-octylphenyl)-benzotriazole, 2-(2'-hydroxy-3',5'-di-t-amylphenyl)-benzotriazole, and the like.

Other examples of photostabilizer include 2,4'di-t-butylphenyl-3',5'-di-t-butyl-4'-hydroxybenzoate, nickel dibutyl-dithiocarbamate, and the like.

The charge transport layer is formed by applying a solution prepared by dissolving the charge transporting material and the binding resin disclosed above in an appropriate solvent, and drying the solution. Examples of the solvent used in the preparation of the coating liquid for charge transport layer formation include aromatic hydrocarbons such as benzene, toluene and chlorobenzene; ketones such as acetone and 2-butanone; halogenated aliphatic hydrocarbons such as methylene chloride, chloroform and ethylene chloride; cyclic or straight-chained ethers such as tetrahydrofuran, dioxane, ethylene glycol and diethyl ether; and the like, and these may be used as solvent mixtures as well.

The coating liquid for charge transport layer formation may also contain silicone oil as a leveling agent for improving the flatness and smoothness of the coating film formed by application of the coating liquid.

Application of the coating liquid for charge transport layer formation may be performed in accordance with the shape or intended use of the photoreceptor, using a coating method such as dip coating, ring coating, spray coating, bead coating, blade coating, roller coating, knife coating or curtain coating. Drying may be performed by dust-free drying (set-to touch drying) at room temperature (for example, 25° C.), followed by heat drying. The heat drying may be carried out at a temperature range of 30° C. to 200° C., for a time period in the range of 5 minutes to 2 hours.

The thickness of the charge transport layer may be generally in the range of 5 μm to 50 μm, and desirably from 10 μm to 40 μm.

The charge generating layer may be formed by depositing a charge generating material by vacuum deposition, or may be formed by applying a solution containing a charge generating material as well as an organic solvent and a binding resin.

As for the charge generating material, selenium compounds such as amorphous selenium, crystalline selenium, selenium-tellurium alloys, selenium-arsenic alloys, and other selenium compounds; inorganic photoconductors such as selenium alloys, zinc oxide and titanium oxide; or products obtained by dye-sensitizing these compounds; various phthalocyanine compounds such as metal-free phthalocyanine, titanyl phthalocyanine, copper phthalocyanine, tin phthalocyanine and gallium phthalocyanine; various organic pigments such as squarylium pigments, anthanthrone pigments, perylene pigments, azo pigments, anthraquinone pigments, pyrene pigments, pyrylium salts and thiapyrylium salts; or dyes may be used.

These organic pigments generally have various crystal forms, and in particular, phthalocyanine compounds are known to have various crystal forms, including α form, β form and the like. However, as long as the pigment is capable of achieving the aimed sensitivity and other properties, any of these crystal forms may be used.

In the case of using a phthalocyanine compound among the charge generating materials described above, when the organic photosensitive layer is irradiated with light, the phthalocyanine compound contained in the organic photosensitive layer absorbs photons and generates carriers. Here, since phthalocyanine compounds have higher quantum efficiencies compared to other species, the phthalocyanine compounds efficiently absorb photons and generate carriers.

Further among the phthalocyanine compounds, phthalocyanines shown in the following (1) to (3) may be used.

(1) As a charge generating material, hydroxygallium phthalocyanine having diffraction peaks at least at the positions of 7.6°, 10.0°, 25.2° and 28.0°, at Bragg's angle (2θ±0.2°) in the X-ray diffraction spectrum obtained using CuKα radiation.

(2) As a charge generating material, chlorogallium phthalocyanine having diffraction peaks at least at the positions of 7.3°, 16.5°, 25.4° and 28.1°, at Bragg's angle (2θ±0.2°) in the X-ray diffraction spectrum obtained using Cu Kα radiation.

(3) As a charge generating material, titanyl phthalocyanine having diffraction peaks at least at the positions of 9.5°, 24.2° and 27.3°, at Bragg's angle (2θ±0.2°) in the X-ray diffraction spectrum obtained using Cu Kα radiation.

These phthalocyanine compounds have, in particular, higher photosensitivity as well as high stability of photosensitivity, compared to other species. Thus, a photoreceptor having an organic photosensitive layer containing such phthalocyanine compound may be suitable as a photoreceptor for color image forming apparatuses, from which high speed image formation and repeated reproducibility are required, as compared to other species.

In addition, there may be cases where the peak intensity or position of a material subtly deviates from the values given above owing to the shape of crystal or the method of measurement; however, if the X-ray diffraction patterns basically coincide, the material is judged to be of the same crystal form.

Examples of the binding resin used in the charge generating layer include the following: polycarbonate resins such as bisphenol A type or bisphenol Z type, and copolymers thereof; polyallylate resins, polyester resins, methacrylic resins, acrylic resins, polyvinyl chloride resins, polystyrene resins, polyvinyl acetate resins, styrene-butadiene copolymer resins, vinylidene chloride-acrylonitrile copolymer resins, vinyl chloride-vinyl acetate-maleic anhydride resins, silicone resins, silicone-alkyd resins, phenol-formaldehyde resins, styrene-alkyd resins, poly-N-vinylcarbazole, and the like.

These binding resins may be used individually or as mixtures of two or more species. The mixing ratio of the charge generating material to the binding resin (charge generating material: binding resin) may be in the range of 10:1 to 1:10 by weight. The thickness of the charge generating layer may be generally in the range of 0.01 μm to 5 μm, and desirably from 0.05 μm to 2.0 μm.

The charge generating layer may also contain at least one electron accepting material, for the purpose of improving the sensitivity, reducing the residual potential, and reducing fatigue upon repeated use. Examples of the electron accepting material used in the charge generating layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, phthalic acid and the like. Among these, fluorenones, quinones or benzene derivatives having an electron withdrawing substituent such as Cl, CN or $NO_2$, may be preferably used.

As for the method of dispersing the charge generating material in the resin, a method using a roll mill, a ball mill, a vibratory ball mill, an attriter, a Dyno mill, a sand mill, a colloid mill or the like, may be used.

As the solvent of the coating liquid for forming a charge generating layer, there may be mentioned known organic solvents, for example, aromatic hydrocarbon solvents such as toluene and chlorobenzene; aliphatic alcohol solvents such as methanol, ethanol, n-propanol, iso-propanol and n-butanol; ketone solvents such as acetone, cyclohexanone and 2-butanone; halogenated aliphatic hydrocarbon solvents such as methylene chloride, chloroform and ethylene chloride; cyclic or straight-chained ether solvents such as tetrahydrofuran, dioxane, ethylene glycol and diethyl ether; ester solvents such as methyl acetate, ethyl acetate and n-butyl acetate; and the like.

These solvents are used individually, or as mixtures of two or more species. When two or more solvents are used as a mixture, any solvent capable of dissolving the binding resin when used as a solvent mixture may be used. However, in the case where the organic photosensitive layer has a layer configuration having a charge transport layer 2B and a charge generating layer formed in this order from the conductive substrate side, if the charge generating layer is to be formed using a coating method that is likely to dissolve the underneath layer, such as dip coating, a solvent which is not likely to dissolve the underneath layer such as the charge transport layer may be used. Also, in the case where the charge generating layer is to be formed using spray coating or ring coating, in which method erosion of the underneath layer is relatively suppressed, the selection range of the solvent is broadened.

Next, the intermediate layer will be described. As for the intermediate layer, for example, a charge injection blocking layer may be formed between the surface layer and the charge generating layer, as necessary, in order to prevent the phenomenon that when the photoreceptor surface is charged by means of an electric charger, the electrical charges are injected from the photoreceptor surface to the conductive substrate of the photoreceptor, which is the electrode, so that charged potential cannot be obtained.

As for the material for the charge injection blocking layer, the above-listed silane coupling agents, titanium coupling agents, organozirconium compounds, organotitanium compounds, other organometallic compounds, and general-purpose resins such as polyesters and polyvinylbutyral, may be used. The thickness of the charge injection blocking layer is appropriately set to the range of about 0.001 μm to 5 μm, considering film forming properties and carrier blocking properties.

<Process Cartridge and Image Forming Apparatus>

Next, the process cartridge and image forming apparatus using the electrophotographic photoreceptor according to the present exemplary embodiment will be described by way of exemplary embodiments.

The process cartridge according to an exemplary embodiment of the invention is not particularly limited as far as the cartridge has the photoreceptor of the exemplary embodiment. Specifically, the process cartridge has as a unit the photoreceptor of the exemplary embodiment, and at least one selected from a charging unit, a developing unit and a cleaning unit. The cartridge is desirably attached to the body of an image forming apparatus and removed therefrom optionally.

The image-forming apparatus of the exemplary embodiment of the invention is not particularly limited as long as a photoreceptor of the exemplary embodiment of the invention is used in the image-forming apparatus. Specifically, the image-forming apparatus of the exemplary embodiment of the invention may include the photoreceptor of the exemplary embodiment of the invention, a charging unit that charges a photoreceptor surface, an exposure unit (an electrostatic latent image forming unit) that forms an electrostatic latent image by photo-irradiating the photoreceptor surface that has been charged by the charging unit, a developing unit that forms a toner image by developing the electrostatic latent image with a toner-containing developer, and a transfer unit that transfers the toner image onto a recording medium. The image-forming apparatus of the exemplary embodiment of the invention may be a so-called tandem apparatus having multiple photoreceptors corresponding to the toners for the respective colors. In this case, all the photoreceptors may be photoreceptors of the exemplary embodiment of the invention. The transfer of the toner image may be conducted in an intermediate transfer manner in which an intermediate transfer medium is used.

Figure 5:
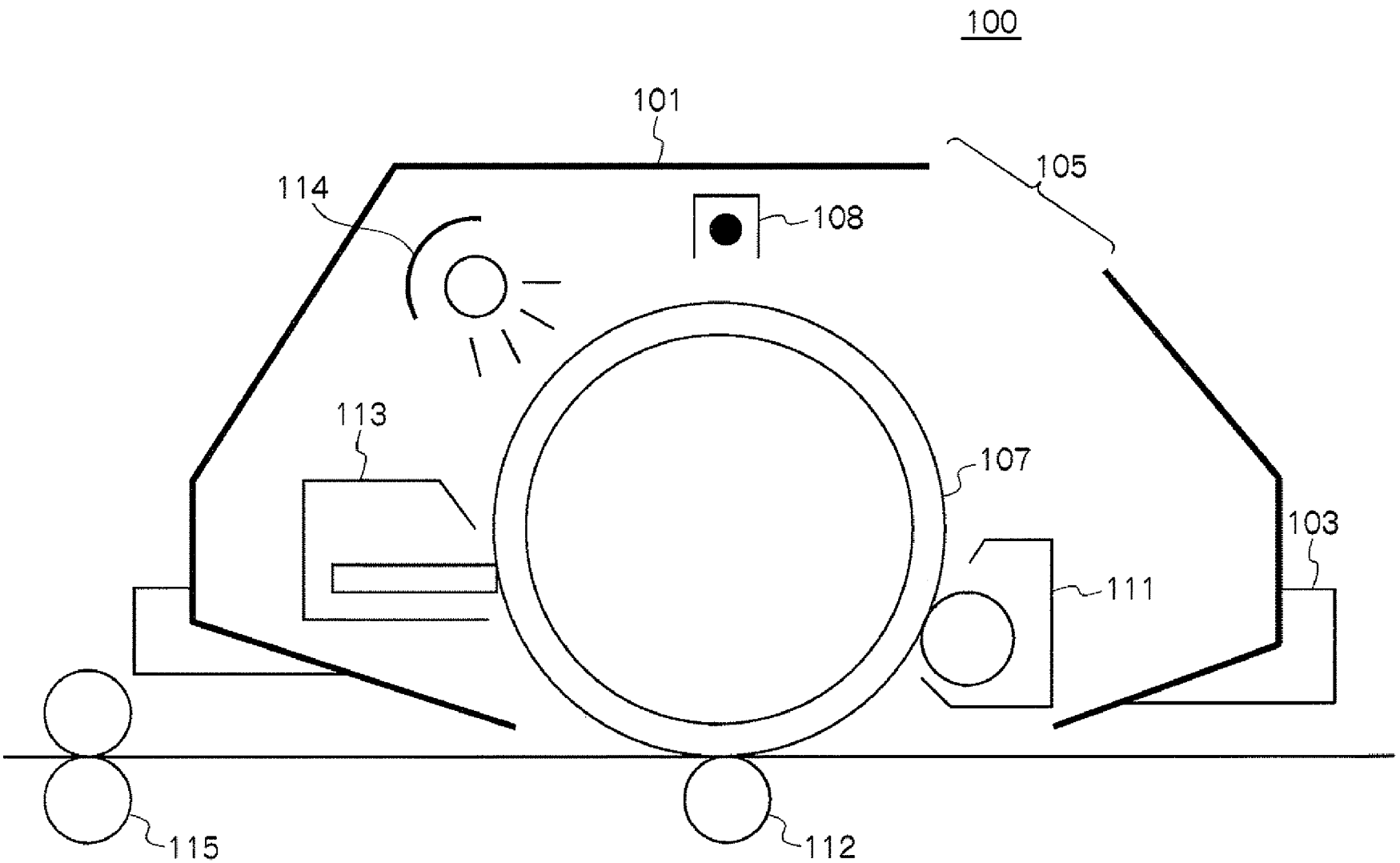
FIG. 5 is a schematic structural view illustrating a basic structure of a proper exemplary embodiment of the process cartridge of the invention.

FIG. 5 is a schematic structural view of a basic structure of a preferred exemplary embodiment of the process cartridge of the invention. A process cartridge 100 is a cartridge wherein an electrophotographic photoreceptor 107, a charging unit 108, a developing unit 111, a cleaning unit 113, an opening section 105 for light-exposure, and a charge eraser 114 are combined into one unit by use of a case 101 and a setting rail 113. This process cartridge 100 is attached to an image forming apparatus body composed of a transferring unit 112, a fixing device 115, and other constituting members not illustrated, and is removed therefrom optionally. The cartridge 100 is combined with the image forming apparatus body to constitute an image forming apparatus.

Figure 6:
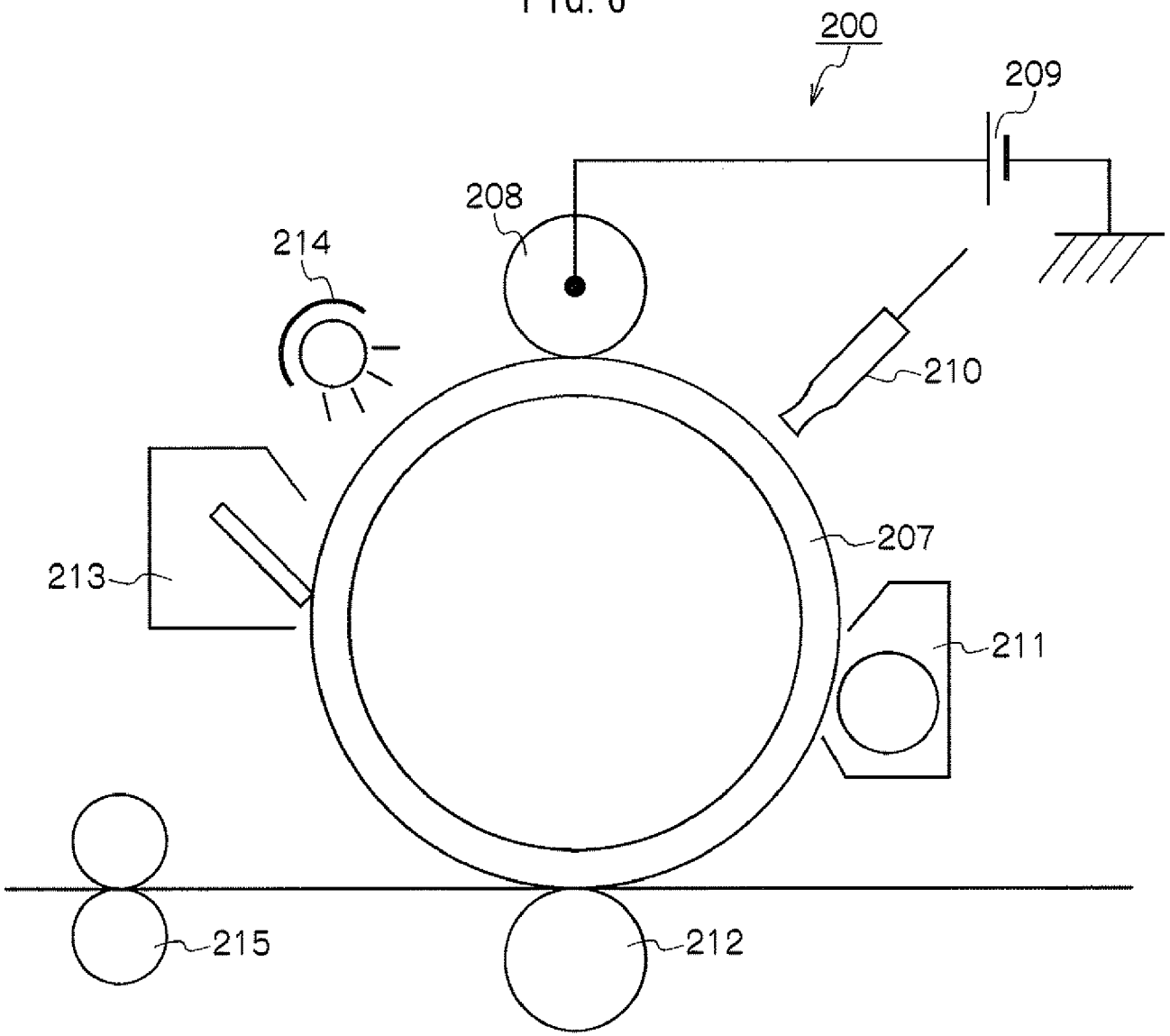
FIG. 6 is a schematic structural view illustrating a basic structure of an exemplary embodiment of the image forming apparatus of the invention.

FIG. 6 is a schematic structural view illustrating a basic structure of an exemplary embodiment of the image forming apparatus of the invention. An image forming apparatus 200 illustrated in FIG. 6 is provided with an electrophotographic photoreceptor 207, a charging unit 208 for charging the electrophotographic photoreceptor 207 in a contact manner, a power source 209 connected to the charging unit 208, an exposing unit 210 for exposing, to light, the electrophotographic photoreceptor 207 charged by the charging unit 208, a developing unit 211 for developing an area of the photoreceptor exposed to the light by the exposing unit 210, a transferring unit 212 for transferring an image obtained by the development on the photoreceptor 207 by the developing unit 211, a cleaning device 213, a charge eraser 214, and a fixing device 215.

In the image forming apparatus according to the exemplary embodiment, the charging unit 208 may be a non-contact type charging unit, such as a corotron or a scorotron, which is different from the contact type charging unit 208.

EXAMPLES

Hereinafter, the invention will be described in more detail with reference to Examples, but the invention is not intended to be limited to these Examples.

Examples 1 to 6 and Comparative Examples 1 to 2

(Fabrication of Electrophotographic Photoreceptor)

—Formation of Undercoat Layer—

100 parts by weight of zinc oxide (average particle diameter: 70 nm, manufactured by Tayca Corp.) is mixed with 500 parts by weight of toluene while stirring, and 1.5 parts by weight of a silane coupling agent (trade name: KBM603, manufactured by Shin-Etsu Chemical Co., Ltd.) is added thereto. The mixture is stirred for 2 hours. Thereafter, toluene is distilled off by distillation under reduced pressure, and baking is performed for 2 hours at 150° C.

38 parts by weight of a solution prepared by dissolving 60 parts by weight of zinc oxide surface treated as above, 15 parts by weight of a curing agent (blocked isocyanate, trade name: SUMIJULE BL3 175, manufactured by Sumitomo Bayer Urethane Co., Ltd.), and 15 parts by weight of a butyral resin (trade name: SLEC BM-1, manufactured by Sekisui Chemical Co., Ltd.) in 85 parts by weight of methyl ethyl ketone, is mixed with 25 parts by weight of methyl ethyl ketone to obtain a treatment liquid.

Subsequently, dispersion treatment is carried out according to the following procedure, using a horizontal media mill disperser (KDL-PILOT type, trade name: DYNO MILL, manufactured by Shinmaru Enterprises Corp.). The cylinder and stirring mill of the disperser are formed from ceramics containing zirconia as the main component. This cylinder is charged with glass beads having a diameter of 1 mm (trade name: HIBEA D20, manufactured by Ohara, Inc.) to a volume packing ratio of 80% by volume, and the dispersion treatment is carried out in a circulatory manner, at a rotating speed of the stirring mill of 8 m/min and at a flow rate of the treatment liquid of 1000 mL/min. The treatment liquid is transported using a magnet gear pump.

In the above dispersion treatment, after a lapse of a predetermined time period, a portion of the treatment liquid is sampled, and the transmittance at the time of film formation is measured. That is, the treatment liquid is applied on a glass plate to have a layer thickness of 20 μm, and curing treatment is performed at 150° C. for 2 hours to form a coating film. Then, the transmittance at a wavelength of 950 nm is determined using a spectrophotometer (trade name: U-2000, manufactured by Hitachi, Ltd.). At the time point where this transmittance (value for a layer thickness of 20 nm) exceeds 70%, the dispersion treatment is finished.

To the dispersion liquid thus obtained, 0.005 parts by weight of dioctyltin dilaurate as a catalyst and 0.01 parts by weight of silicone oil (trade name: SH29PA, manufactured by Toray Dow Coming Silicone Co., Ltd.) are added to prepare a coating liquid for undercoat layer. This coating liquid is applied onto a cylindrical aluminum substrate having a diameter of 30 mm, a length of 404 mm and a thickness of 1 mm by a dip coating method, and dry curing is performed at 160° C. for 100 minutes, to form an undercoat layer having a layer thickness of 20 μm.

—Formation of Organic Photosensitive Layer—

An organic photosensitive layer composed of a charge generating layer and a charge transport layer is formed on the undercoat layer as follows. First, a mixture including 15 parts by weight of chlorogallium phthalocyanine having diffraction peaks at least at the positions of 7.4°, 16.6°, 25.5° and 28.3° at Bragg's angle (2θ±0.2°) in the X-ray diffraction spectrum obtained using Cu Kα radiation, as a charge generating material, 10 parts by weight of a vinyl chloride-vinyl acetate copolymer resin (trade name: VMCH, manufactured by Nippon Unicar Co., Ltd.) as a binding resin, and 300 parts by weight of n-butyl alcohol, is subjected to dispersion treatment for 4 hours with a sand mill using glass beads having a diameter of 1 mm, to obtain a coating liquid for charge generating layer. The obtained dispersion is applied on the undercoat layer by dip coating, and dried to form a charge generating layer having a layer thickness of 0.2 μm.

4 parts by weight of N,N'-diphenyl-N,N'-bis(3-methylphenyl)-[1,1']biphenyl-4,4'-diamine and 6 parts by weight of a bisphenol Z polycarbonate resin (viscosity average molecular weight: 40,000) are added to 80 parts by weight of chlorobenzene and dissolved therein, to obtain a coating liquid for charge transport layer. This coating liquid is applied on the charge generating layer, and dried at 130° C. for 40 minutes, to form a charge transport layer having a layer thickness of 25 μm, Thus, an organic photoreceptor (non-coated photoreceptor) is obtained.

—Formation of a Surface Layer—

Subsequently, a surface layer is formed on the non-coated photoreceptor by plasma CVD as follows: the non-coated photoreceptor is introduced into the plasma CVD machine illustrated in FIG. 4, and the vacuum chamber 32 is degassed to a pressure of $1\times10^{-2}$ Pa to produce a vacuum. Next, hydrogen gas is supplied into the vacuum chamber 32 at a supply flow rate of 100 sccm, He-diluted oxygen (4%) at the supply flow rate shown in Table 1 and hydrogen-diluted trimethyl gallium (about 10%) at the supply flow rate shown in Table 1, from a gas supply line through the mass flow controller 36 while conductance valves are adjusted to adjust the pressure in the vacuum chamber 32 to the pressure shown in Table 1. By use of the high-frequency power source 58 (500-W high-frequency power source (trade name: HFS-005A) manufactured by Nihon Koshuha Co., Ltd.) and the matching box 56 (auto-matching box (ttrade name: MBA-005) manufactured by Nihon Koshuha Co., Ltd.), radiofrequency waves having a frequency of 13.56 MHz are set to the power value (rf power) shown in Table 1. While matching is conducted through a tuner, the power of reflective waves is set to 0 W to perform an electric discharge from the discharge electrode 54. At this time, the self bias voltage is monitored on a VDC monitor (trade name: VDC-D-COP, manufactured by Nihon Koshuha Co., Ltd.) connected to the matching box. In this state, a film is formed for the film-forming period shown in Table 1 while the non-coated photoreceptor is rotated at a rate of 40 rpm, so as to provide the respective surface-layer-attached photoreceptors. The supply of the trimethyl gallium gas is conducted by bubbling trimethyl gallium kept at a temperature of 10° C. with hydrogen as a carrier gas. Under the very same conditions, the process is repeated once more. Thus, under the same conditions, two photoreceptors of each of Examples 1 to 6 and Comparative Examples 1 and 2 are obtained. One of the photoreceptors is used for breaking analysis, and the other is used for evaluation of photoreceptor properties. The film-forming conditions in the respective Examples and Comparative Examples are shown in Table 1.

[Breaking Analysis Evaluation of the Surface Layer in each of the Electrophotographic Photoreceptors]

—Film Thickness Measurement According to Cross Section Observation with an SEM—

Each of the photoreceptors for breaking analysis is cut out along a direction perpendicular to the surface, and the surface of the resultant piece is covered with a polymer resin to embed the piece into the resin. Thereafter, the piece is cut with a microtome, and the cross section is observed with a scanning electron microscope (SEM) (trade name: JSM6340F, manufactured by JEOL Co., Ltd., magnification power: 20000) to measure the film thickness. The results are shown in Table 2.

—Measurement of the Atomic Number Density in each of the Films and the Composition Thereof According to RBS & HFS—

Each of the photoreceptors for breaking analysis is cut out along a direction perpendicular to the surface, and the atomic number density in the film is measured and evaluated according to Rutherfold backscattering spectrometry (RBS) and hydrogen forwardscattering spectrometry (HFS). The machine used is a backscattering measuring machine (trade name: AN-250, manufactured by NHV Corp.), and conditions for the measurement are as follows: incident ions are $^{4}He^{+}$, the voltage thereof is 23 MeV, and the incident angle is 75°. In connection with the positions of detectors, the scattering angle is set to 160° in the RBS measurement, and the recoiling angle is set to 30° in the HFS measurement. From the analysis of the resultant spectra, the surface density of the atoms is obtained. This and the film thickness value obtained from the cross section observation with the SEM are used to calculate the atomic number density in the film. The results are shown in Table 2. From the measurement results of RBS and HFS, the element composition of each of the films is analyzed. The results are shown in Table 3.

[Electrophotographic Photoreceptor Evaluation]

—Observation of an Initial Cracking State of each of the Photoreceptors—

The surface of each of the photoreceptor for photoreceptor characteristic evaluation is observed after 10 days from the production thereof as follows: a lens (trade name: VH-Z450, manufactured by Keyence Corp.) is combined with a microscope (trade name: VEX, manufactured by Keyence Corp.), and the combination is used to observe 20 fields in the surface with a magnification power of 450 while the observing spot is changed on the photoreceptor, each of the fields being an area of about 700 μm×500 μm size. In this way, it is examined whether or not the photoreceptor cracks after the photoreceptor is left to stand after the surface layer is formed.

Furthermore, each of the photoreceptors is installed in a process cartridge for a printing machine (trade name: Docu- Centre Color a 450, manufactured by Fuji Xerox Co., Ltd.), and the photoreceptor is rotated 1000 times. Thereafter, in the same way as described above, the photoreceptor surface is observed to examine whether or not the photoreceptor cracks after the cartridge is set up. Additionally, in the same way as described above, the photoreceptor surface is observed after a printing test.

—Printing Test—

Next, each of the photoreceptors for evaluation of photoreceptor properties is installed in a printing machine (trade name: DocuCentrer Color a 450, manufactured by Fuji Xerox Co., Ltd.) to perform a printing test at a high temperature of 28° C. and a high relative humidity of 85% as follows:

First, 10000 test charts are outputted, which each contain a halftone region having a pixel density of 200 dpi (dots per inch: the number of dots per inch) and an area coverage percentage of 20%, and a 0.2-mm line-and-space (lateral ladder) region along a direction perpendicular to the processing direction. Thereafter, the power switch of the machine is turned off, and the machine is left as it is for 10 hours. Thereafter, the switch is turned on to output 100 image samples after the pause. Out of the thus obtained image samples, the $1^{st}$ sample after the pause, the $10^{th}$ sample thereafter, and the $100^{th}$ sample thereafter are evaluated from the following viewpoint:

A: In the $1^{st}$, $10^{th}$, and $100^{th}$ samples after the pause, no abnormality is observed in the halftones or in the ladders.

B: In the $1^{st}$ sample after the pause, an abnormality is observed in the halftone or the ladder; however, in the $10^{th}$ and $100^{th}$ samples, no abnormality is observed.

C: In each of the $1^{st}$, $10^{th}$, and $100^{th}$ samples after the pause, an abnormality is observed in the halftone or the ladder.

The photoreceptors used in Examples 1 to 6 are stored at temperature of 5° C. for 24 hours after the printing test. As a result, in the photoreceptor of Example 4, the surface layer peels off; however, in the photoreceptors of the other Examples 1-3, and 5-6, the surface layer does not peel off and no problems arise.

TABLE 1

| | H-diluted TMGa supply flow rate (sccm) | He-diluted oxygen supply flow rate (sccm) | Supply flow rate of He-diluted oxygen to TMGa | rf Power supply (W) | self bias voltage (V) | Pressure (Pa) | Film-formation period (minutes) |
|---|---|---|---|---|---|---|---|
| Example 1 | 8.0 | 4.5 | 0.6 | 100 | 220 | 25 | 300 |
| Example 2 | 9.2 | 7.0 | 0.8 | 150 | 215 | 50 | 280 |
| Example 3 | 10.0 | 10.0 | 1.0 | 200 | 350 | 50 | 240 |
| Comparative Example 1 | 6.0 | 2.0 | 0.3 | 75 | 150 | 50 | 400 |
| Comparative Example 2 | 8.0 | 5.0 | 0.6 | 100 | 190 | 50 | 320 |
| Example 4 | 9.2 | 7.0 | 0.8 | 150 | 215 | 50 | 1900 (380 × 5) |
| Example 5 | 9.2 | 7.0 | 0.8 | 150 | 215 | 50 | 260 |
| Example 6 | 9.2 | 7.0 | 0.8 | 150 | 215 | 50 | 1500 (300 × 5) |

TABLE 2

| | Electrophotographic photoreceptor surface layer | | | | | |
|---|---|---|---|---|---|---|
| | RBS & HFS Atomic number density ($\times 10^{22}$ cm$^{-3}$) | Cross section SEM Film thickness (μm) | Crack observation results according to microscope: At 10 days after layer-production | After fitting of cartridge into image forming apparatus | After printing test | Printing test Images after pause |
| Example 1 | 8.2 | 1.6 | A | A | A | A |
| Example 2 | 8.0 | 1.6 | A | A | A | A |
| Example 3 | 8.6 | 1.6 | A | A | A | A |
| Comparative Example 1 | 7.0 | 1.6 | C (Cracked) | C | C | C |
| Comparative Example 2 | 7.5 | 1.6 | A | C | C | C |
| Example 4 | 8.6 | 10.9 | C (Peeled) | (Not evaluated) | (Not evaluated) | (Not evaluated) |
| Example 5 | 8.6 | 1.4 | A | A | B (Cracked into bruise form) | B |
| Example 6 | 8.6 | 8.6 | A | A | A | A |

TABLE 3

| | Electrophotographic photoreceptor surface layer | | | | | |
|---|---|---|---|---|---|---|
| | Composition (% by atom) | | | Sums of proportions of all or some of constituting elements (Total proportions thereof) | | Ratio between specified ones of constituting elements |
| | Ga | O | H | Ga + O | Ga + O + H | O/Ga |
| Example 1 | 36.1 | 46.9 | 17.0 | 83.0 | 100 | 1.30 |
| Example 2 | 35.8 | 47.4 | 16.8 | 83.2 | 100 | 1.32 |
| Example 3 | 34.1 | 48.5 | 17.1 | 82.6 | 100 | 1.42 |
| Comparative Example 1 | 37.3 | 43.8 | 18.9 | 81.1 | 100 | 1.17 |
| Comparative Example 2 | 36.8 | 45.2 | 18.0 | 82.0 | 100 | 1.23 |
| Example 4 | 36.0 | 47.3 | 16.7 | 83.3 | 100 | 1.31 |
| Example 5 | 35.7 | 47.4 | 16.9 | 83.1 | 100 | 1.33 |

According to the results, it is understood that the electrophotographic photoreceptors of the Examples less crack or peel than those of the Comparative Examples.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

an electroconductive substrate;

a photosensitive layer arranged on or above the electroconductive substrate; and a surface layer arranged on or above the photosensitive layer, and containing about 90% or more by atom of gallium (Ga), oxygen (O) and hydrogen (H), and having an atomic number density of about $7.8\times10^{22}$ $cm^{-3}$ or more in the layer.

2. The electrophotographic photoreceptor according to claim 1, wherein the atomic number density is from about $7.8\times10^{22}$ $cm^{-3}$ to about $10.4\times10^{22}$ $cm^{-3}$.

3. The electrophotographic photoreceptor according to claim 1, wherein the film thickness of the surface layer is from about 1.5μm to 10.0μm.

4. The electrophotographic photoreceptor according to claim 1, wherein the element composition ratio of oxygen to gallium (oxygen/gallium) is from about 1.1 to about 1.5.

5. The electrophotographic photoreceptor according to claim 1, wherein the total proportion of oxygen, gallium and hydrogen is about 95% or more by atom and the element composition ratio of oxygen to gallium (oxygen/gallium) is from about 1.1 to about 1.4.

6. The electrophotographic photoreceptor according to claim 1, wherein the photosensitive layer is an organic photosensitive layer.

7. A process cartridge comprising, as a unit:

an electrophotographic photoreceptor comprising:

an electroconductive substrate;

a photosensitive layer arranged on or above the electroconductive substrate; and a surface layer arranged on or above the photosensitive layer, and containing about 90% or more by atom of gallium (Ga), oxygen (O) and hydrogen (H), and having an atomic number density of about $7.8\times10^{22}$ $cm^{-3}$ or more; and at least one selected from the group consisting of an charging unit for charging the electrophotographic photoreceptor, a developing unit for developing an electrostatic latent image formed on the electrophotographic photoreceptor charged by the charging unit with a developing agent containing a toner, and a cleaning unit for removing an adherent substance adhered to the electrophotographic photoreceptor.

8. The process cartridge according to claim 7, wherein the atomic number density is from about $7.8\times10^{22}$ $cm^{-3}$ to about $10.4\times10^{22}$ $cm^{-3}$.

9. The process cartridge according to claim 7, wherein the film thickness of the surface layer is from about 1.5μm to 10.0μm.

10. The process cartridge according to claim 7, wherein the element composition ratio of oxygen to gallium (oxygen/gallium) is from about 1.1 to about 1.5.

11. The process cartridge according to claim 7, wherein the total proportion of oxygen, gallium and hydrogen is about 95% or more by atom and the element composition ratio of oxygen to gallium (oxygen/gallium) is from about 1.1 to about 1.4.

12. The process cartridge according to claim 7, wherein the photosensitive layer is an organic photosensitive layer.

13. An image forming apparatus comprising:

an electrophotographic photoreceptor comprising:

an electroconductive substrate;

a photosensitive layer arranged on or above the electroconductive substrate; and a surface layer arranged on or above the photosensitive layer, and containing about 90% or more by atom of gallium (Ga), oxygen (O) and hydrogen (H), and having an atomic number density of about $7.8\times10^{22}$ $cm^{-3}$ or more;

an charging unit for charging the electrophotographic photoreceptor;

an electrostatic latent image forming unit for forming an electrostatic latent image on the electrophotographic photoreceptor charged by the charging unit;

a developing unit for developing the electrostatic latent image into a toner image with a developing agent containing a toner; and a transferring unit for transferring the toner image onto a recording medium.

14. The image forming apparatus according to claim 13, wherein the atomic number density is from about $7.8\times10^{22}$ $cm^{-3}$ to about $10.4\times10^{22}$ $cm^{-3}$.

15. The image forming apparatus according to claim 13, wherein the film thickness of the surface layer is from about 1.5μm to 10.0μm.

16. The image forming apparatus according to claim 13, wherein the element composition ratio of oxygen to gallium (oxygen/gallium) is from about 1.1 to about 1.5.

17. The image forming apparatus according to claim 13, wherein the total proportion of oxygen, gallium and hydrogen is about 95% or more by atom and the element composition ratio of oxygen to gallium (oxygen/gallium) is from about 1.1 to about 1.4.

18. The image forming apparatus according to claim 13, wherein the photosensitive layer is an organic photosensitive layer.

* * * * *